US008726549B2

(12) United States Patent
Regas

(10) Patent No.: US 8,726,549 B2
(45) **Date of Patent: *May 20, 2014**

(54) SYSTEMS AND METHODS FOR AN INFORMATIONAL ATTACHMENT ON A CONTAINER

(71) Applicant: John P. Regas, Carlsbad, CA (US)

(72) Inventor: John P. Regas, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/873,392

(22) Filed: Apr. 30, 2013

(65) Prior Publication Data

US 2013/0232838 A1 Sep. 12, 2013

Related U.S. Application Data

(63) Continuation of application No. 13/279,275, filed on Oct. 22, 2011, now Pat. No. 8,429,839, which is a continuation of application No. 12/252,651, filed on Oct. 16, 2008, now Pat. No. 8,065,827.

(60) Provisional application No. 60/981,449, filed on Oct. 19, 2007.

(51) Int. Cl.
*G09F 3/00* (2006.01)
*G09F 3/04* (2006.01)

(52) U.S. Cl.
CPC ..... *G09F 3/04* (2013.01)
USPC ..... 40/310; 40/654.01

(58) Field of Classification Search
USPC ..... 40/310
See application file for complete search history.

(56) References Cited

U.S. PATENT DOCUMENTS

| | | | | |
|---|---|---|---|---|
| 54,665 | A * | 5/1866 | Atterbury | 40/310 |
| 823,008 | A * | 6/1906 | Vendig | 40/310 |
| 1,273,105 | A * | 7/1918 | Van Dyke | 283/106 |
| 1,686,354 | A * | 10/1928 | Wallace | 40/310 |
| 1,974,401 | A * | 9/1934 | Miller | 40/306 |
| 5,172,936 | A * | 12/1992 | Sullivan et al. | 283/81 |
| 2006/0163103 | A1 * | 7/2006 | Adler et al. | 206/459.5 |

* cited by examiner

*Primary Examiner* — Kristina Junge
(74) *Attorney, Agent, or Firm* — Lweis Kohn & Fitzwilliam LLP; Kent M. Walker; Kari Moyer-Henry

(57) ABSTRACT

Embodiments described herein include a single-use beverage container assembly having a beverage container which includes an inner surface defining a chamber capable of receiving a liquid, an opening configured to provide access to the chamber and an outer surface comprising a receiving cavity. In certain embodiments, the beverage container further includes an informational attachment including promotional information. The receiving cavity can be configured to receive the informational attachment such that the informational attachment can be stowed in the receiving cavity. The beverage container assembly can also be configured to permit the informational attachment to be at least partially removed from the receiving cavity such that the informational attachment can be separated from the beverage container.

14 Claims, 13 Drawing Sheets

SYSTEMS AND METHODS FOR AN INFORMATIONAL ATTACHMENT ON A CONTAINER

This application is a Continuation Patent Application claiming the benefit of priority under 35 U.S.C. 120 from U.S. patent application Ser. No. 13/279,275 filed Oct. 22, 2011, which claims priority from U.S. application Ser. No. 12/252,651 filed Oct. 16, 2008, which further claims priority from U.S. Provisional Application No. 60/981,449, filed Oct. 19, 2007, the entire contents of which are herein incorporated by reference.

BACKGROUND

The present disclosure relates to the field of bottles, containers and related labeling and to promotion of a business or services in connection therewith.

Techniques exist for affixing wrappers having supplemental material to containers. For example, some approaches include attaching wrappers to containers which integrate additional product information, detachable coupons or stickers. The type and amount of information that can be added by these techniques is limited. For example, a container including a bulky attachment may be difficult to grip, become snagged resulting in damage to the container or attachment, or be unattractive in general. In addition, traditional means of attaching supplemental material to containers do not allow the end-user or down-stream seller much flexibility in affixing the material, nor do they provide an elegant vehicle for the presentation of the supplemental material.

SUMMARY

Certain embodiments of the present disclosure include a beverage container configured for single use. The beverage container includes an inner surface defining a chamber capable of receiving a liquid and an outer surface having a raised portion and a recessed portion, the recessed portion recessed from the raised portion by a first depth. The beverage container further includes an opening configured to provide access to the chamber and an informational attachment including promotional information and attached to the outer surface such that the informational attachment is substantially disposed within the recessed portion. The informational attachment can be movable from a secured state in which the informational attachment is substantially secured to the outer surface to a released state in which at least a portion of the informational attachment is separated from the outer surface. The informational attachment has a first thickness when in the secured state wherein the first thickness is not substantially greater than the first depth. The informational attachment does not extend substantially beyond the raised portion when in the secured state. In certain embodiments, the promotional information comprises marketing or advertising information.

In certain embodiments, the first depth is in the range of about 0.25 mm to about 3 mm. The informational attachment is disposed on only a portion of the outer surface of the bottle in some embodiments.

In some configurations, the outer surface comprises at least one substantially flat panel, the at least one panel including at least a part of the raised portion and at least a part of the recessed portion, the at least a part of the recessed portion defining a recessed plane bordered by the at least a part of the raised portion. The chamber comprises a substantially rectangular prism in some embodiments.

The informational attachment of certain configurations comprises a plurality of foldable leafs positioned in a folded configuration when the informational attachment is in the secured state and positioned in an unfolded configuration in the released state.

In some embodiments, at least a portion of the informational attachment is detachable from a remaining portion of the informational attachment. For example, the at least a portion of the informational attachment can be detachable via a perforation.

Certain embodiments of the disclosure provide a single-use beverage container assembly including a beverage container having an inner surface defining a first enclosed chamber capable of receiving a liquid, the chamber being accessible through a chamber opening and an outer surface. The beverage container further includes an information receptacle disposed on the outer surface for attaching a promotional item to the container, the information receptacle having a second chamber capable of receiving at least a portion of the promotional item and at least one opening providing access to the second chamber.

The information receptacle of some embodiments comprises a pocket and the at least one opening comprises a slot providing access to the pocket. In certain configurations, the information receptacle comprises an at least partially elastic material such that the promotional item is secured to the container by force exerted on the promotional item by the securing portion, the force substantially normal to and in the direction of the outer surface. For example, the information receptacle comprises a strip secured to the outer surface on either end of the strip. The information receptacle comprises transparent material in some embodiments. The promotional item can comprise a business card, for example.

Embodiments of a single-use beverage container assembly are described herein which include a beverage container having an inner surface defining a chamber capable of receiving a liquid, an opening configured to provide access to the chamber, an outer surface comprising a receiving cavity and an informational attachment including promotional information. In certain embodiments, the receiving cavity is configured to receive the informational attachment such that the informational attachment can be stowed in the receiving cavity. The beverage container assembly can be configured to permit the informational attachment to be at least partially removed from the receiving cavity such that the informational attachment can be separated from the beverage container.

The receiving cavity of some embodiments is defined by a pocket including an opening for providing access to the pocket. The receiving cavity can be defined by an at least partially elastic material such that the informational attachment is secured to the container by force exerted on the informational attachment by the elastic material, the force substantially normal to the outer surface. The informational attachment can comprise a business card, for example.

In certain configurations, the receiving cavity is defined by a recessed portion of the outer surface bordered by a raised portion of the outer surface, the recessed portion recessed from the raised portion by a first depth.

The outer surface of certain embodiments comprises at least one substantially flat panel which includes at least a part of the raised portion and at least a part of the recessed portion, the at least a part of the recessed portion defining a recessed plane bordered by the at least a part of the raised portion.

In some embodiments, the informational attachment has a first thickness in the secured state that is not substantially greater than the first depth such that the informational attachment does not extend substantially beyond the raised portion when in the secured state. The first depth is in the range of about 0.25 mm to about 3 mm, for example.

In certain embodiments, a method of securing an informational attachment to a single-use beverage container is provided. The method includes providing a container comprising a chamber defining a volume, the chamber comprising an outer surface and an opening configured to provide access to the chamber. The method also includes securing an informational attachment to the outer surface in a secured state, the informational attachment movable from the secured state in which the information attachment is substantially secured to the outer surface to a released state in which at least a portion of the informational attachment is separated from the outer surface.

In some embodiments, the outer surface includes a raised portion and a recessed portion, the recessed portion recessed from the raised portion by a first depth and the securing further comprises disposing the informational attachment substantially within the recessed portion such that the informational attachment is either substantially flush with respect to the raised portion or recessed with respect to the raised portion when in the secured state. In some embodiments, the moving includes moving the informational attachment from the secured state to the released state. The informational attachment comprises a plurality of leafs in some embodiments and the securing further comprises folding the plurality of leafs. In some embodiments, the method further includes detaching at least a portion of the informational attachment from the remaining portion of the informational attachment.

DETAILED DESCRIPTIONS OF THE DRAWINGS

Aspects of the present disclosure include labeling elements that can be attached to a container. The labeling elements can enhance the container's effectiveness for conveying information to users e.g., for marketing, promotions, and any other type of information transfer.

In one embodiment, a bottle can be used to generate interest in an object for promotional purposes. The bottle can include a label that markets or promotes a product or service. Beyond promoting the particular product to which the label and other aspects of package arrangement relate, the label can constitute a unique device for promoting goods, services, ideas, or other information that may be important, regardless of the object to which it is attached. The orientation of the labels relative to the bottle can further enhance the bottle's effectiveness at conveying information.

Another embodiment of this disclosure has an information receptacle disposed on an outer surface of a beverage container for attaching a promotional item to the container. Embodiments of the attachment element can provide the user flexibility in presenting and affixing the promotional item. For example, the attachment element can be configured to allow the user to replace the promotional item once it has been detached from the container. In addition, in certain embodiments an end-user or down-stream seller may be able to select, secure, or re-secure the promotional item to the container themselves after purchase, rather than having to rely on the bottle manufacturer or other up-stream party to do so. For example, the container may include a pocket formed from a suitable material, such as semi-transparent, transparent, or opaque material. The pocket can contain a slit into which a business card or other object is can be at least partially inserted.

The slit can be replaced with a clip, magnet, or other element that serves to immobilize or temporarily secure the card or other object adjacent to the bottle or other surface. An element ensuring that a card, for example, does not slide down too far into the pocket can be included in still another embodiment.

Figure 1A:
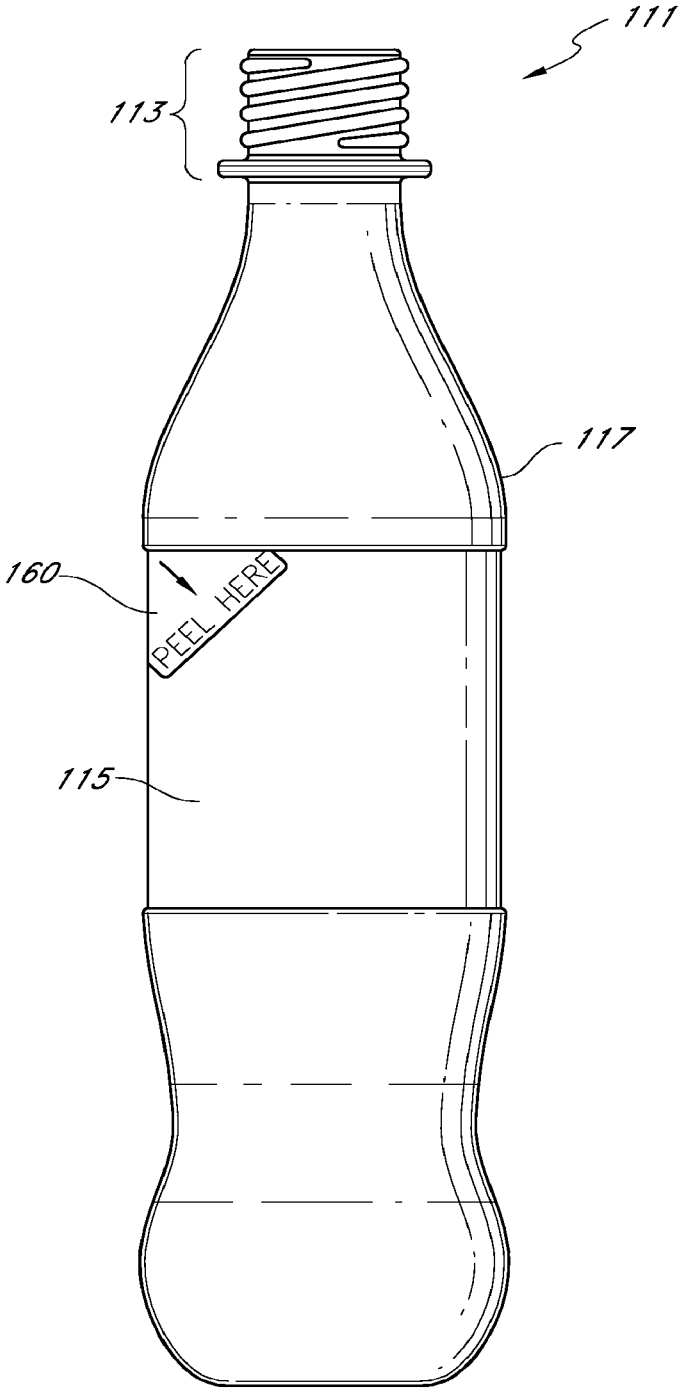
FIG. 1A shows a bottle with an expandable label in a folded configuration.
Figure 1B:
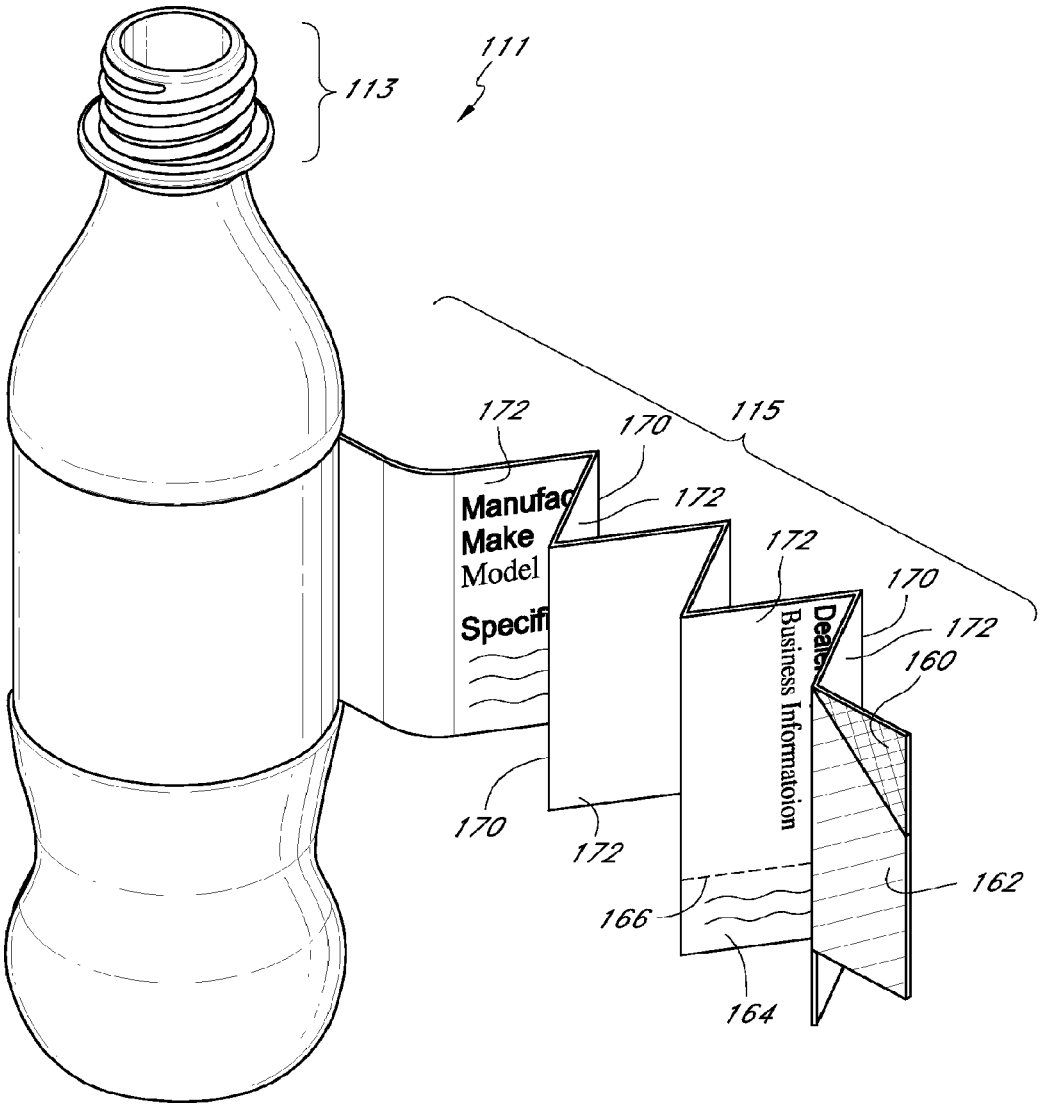
FIG. 1B shows the embodiment of FIG. 1A in an extended configuration.

FIGS. 1A and 1B show one embodiment of the present disclosure. A bottle capable of storing a beverage is coupled to an informational label. The bottle 111 has a dispensing and receiving element 113 that includes a removable and replaceable cap (not shown) and a neck and allows the bottle to be maneuvered by bottling equipment of conventional design or, alternatively, by bottling equipment specially designed to accommodate a particular bottle configuration. The bottle also has a label 115. An adhesive or similar device couples at least a portion of the label to the bottle. The label remains coupled to the bottle until a user changes the configuration of the label 115 relative to the bottle. The label 115 can include a tab element 160 designed to allow a user to easily separate at least a portion of the label 115 from the bottle 111. Referring to FIG. 1A, at least a portion of the label 115 is coupled to the bottle's outer side wall 117 such that the at least part of the label 115 may be removed from the bottle 111 or may remain in place as the user prefers.

To achieve the configuration shown in FIG. 16, users can peel the tab 160 away from its original position, shown in FIG. 1A, starting with the tabbed portion 162 of the edge of the label 115, to reveal portions of the bottle 111 or label lying beneath an outer surface of the label. Force created by the user pulling the tab 160 causes the tabbed portion 162 to separate from the bottle. The tabbed panel 162 separates from the bottle 111 such that the user can grasp the tabbed panel 162 and pull the label 115 from the bottle e.g., using force distributed along the label's width. Such force distribution helps ensure that the label 115 does not prematurely detach from the bottle 111 and that the label 115 can be removed from the bottle without leaving an unwanted residual portion of the label material coupled to the bottle 111.

FIG. 1B shows the label 115 in an extended configuration and shows that the label 115 can have a perforated line 166 extending entirely or partially from one end of the label 115 to another. The previously hidden label portion 172 can be separated from the bottle's outer side wall 117 to reveal printed matter or other portions containing information. Here, the label 115 is creased and perforated to facilitate folding and unfolding, which also makes the label 115 easily separable for convenient reading or storage. A plurality of label panels 172 extend from the bottle. The panels 172 can provide information. A perforated panel 164 can be provided with a perforated upper edge. The front and back sides of each panel can provide users with further information. The perforated line 166 can separate the panel having a perforated upper edge 164 from any adjacent panels and allows users to de-couple a portion of the label 115 from the bottle 111 to be retained by the user for future reference. The perforated line 166 allows the user to detach the panel 164 from the remainder of the label 115 without needing to use a tool to cut the label 115.

In one mode to preserve coupling between the other label panels 172 and the bottle, the perforation 166 can be torn before the label 115 is separated from the bottle 111 or from any other portion of the label. Creases or fold lines facilitate folding portions of the label 115 beneath the surface initially exposed entirely to the user.

FIG. 1B shows the panels 172, 164 in their folded out configuration and extending from the portion of the label 115 directly coupled to the bottle 111. Here, the perforated line 166 remains intact, the label panels 172, 164 are coupled to one another and the label 115 is extended, or unfolded, from the accordion like fold in which it began. The plurality of panels 172, 164 shown contain marketing or other information intended to come to users' attention.

Figure 2B:
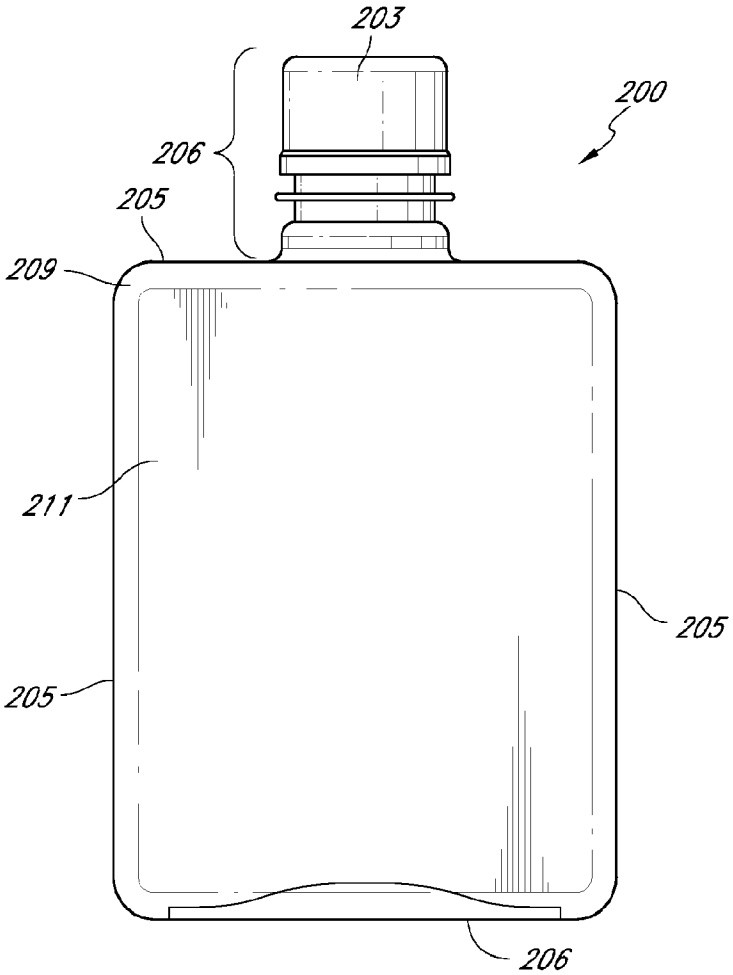
FIG. 2B shows another side of the embodiment of FIG. 2A
Figure 2A:
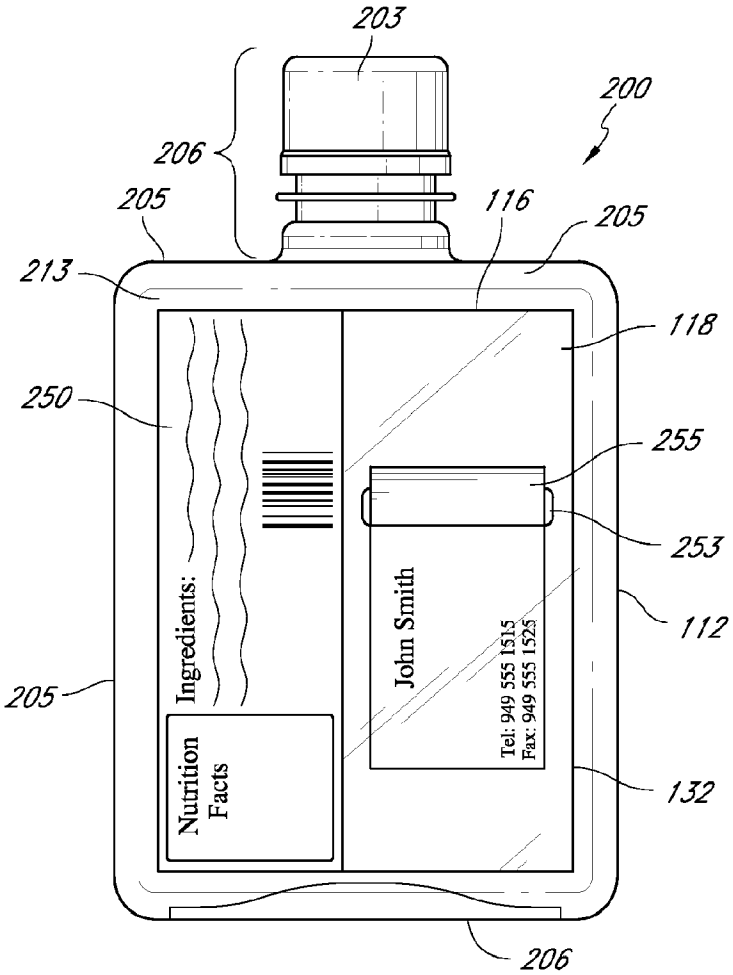
FIG. 2A shows another embodiment having promotional information coupled to one side of the bottle.

FIGS. 2A and 2B show another embodiment. FIG. 2B shows a bottle 200 having rectangular sides 205 and a bottom 206. The area of two of the sides 205 is typically visible when the bottle rests on its bottom 206 upright upon a surface. The bottle 200 has a dispensing and receiving element 206 that includes a removable and replaceable cap 203 and a neck and allows the bottle to be used with bottling equipment. The bottle also has front surface 209 and back 205 surfaces 213. Coupled to the front surface 209 is an informational label 211. The back surface 205 also has an informational label 116, which has a regulatory compliance and/or inventory portion 250 and a marketing portion 118. The regulatory compliance and/or inventory portion 250 can display facts typically shown on food or beverage containers. The label's marketing portion 118 can have a pocket formed by coupling transparent or semi-opaque material, such as plastic, to the bottle 200 and to the regulatory compliance and/or marketing portion 240 of the back panel 213. Inside the pocket rests a business or promotional card 255 or other information containing items that can be seen protruding above the slot 253 into which it is inserted. The portion of the card within the pocket is visible through the present embodiment's transparent material. Although described with respect to a business card, a skilled artisan will recognize that any type of promotional attachment of many sizes or shapes can be used.

Figure 2D:
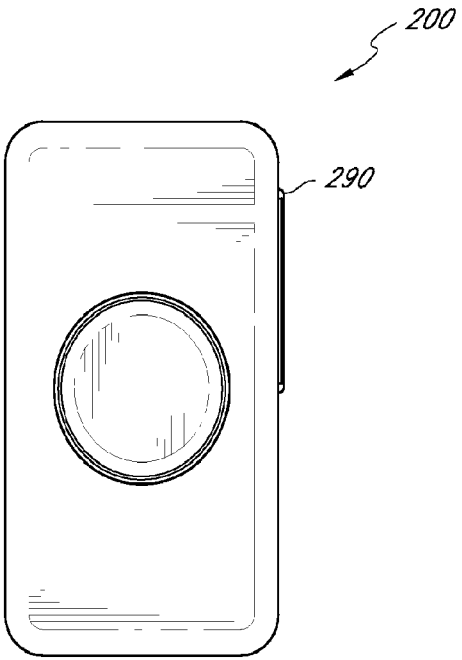
FIG. 2D shows a top view of the embodiment shown in FIG. 2A.
Figure 2C:
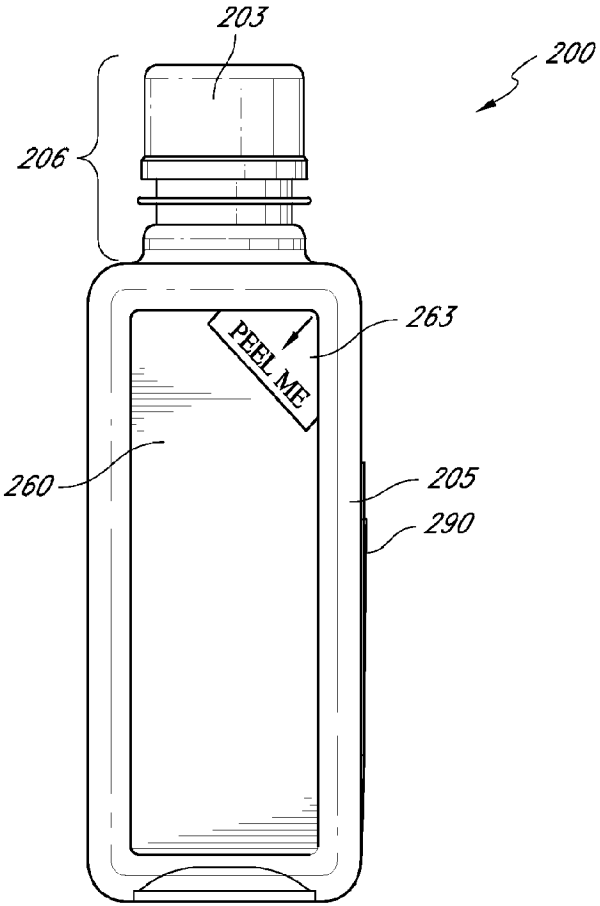
FIG. 2C shows a side view of the embodiment shown in FIG. 2A.
Figure 2E:
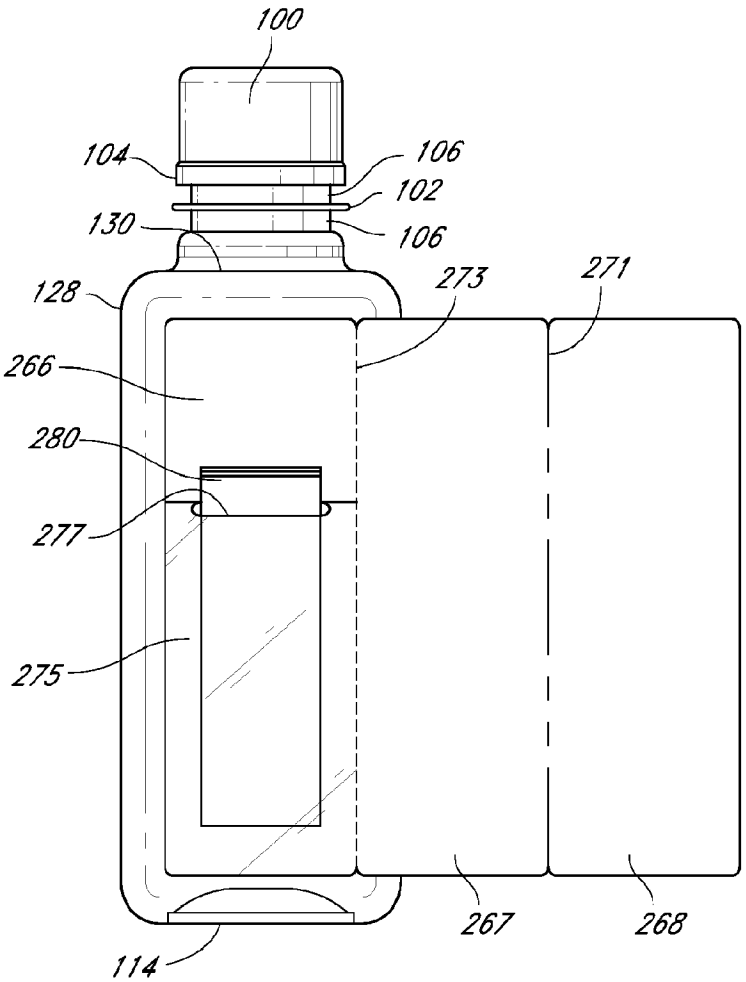
FIG. 2E shows another side view similar to FIG. 2C where an informational attachment is in an extended configuration.

FIG. 2C shows a side perspective of this embodiment, which has an additional tabbed label 260. FIG. 2E shows the tabbed label 260 after it has been folded or peeled away from the bottle 200. FIG. 2E shows that the label can be creased along a fold line 271 and/or along a perforated line 273 to facilitate folding and unfolding. The perforated line 273 also makes the label 260 easily separable for convenient reading or storage. The perforated line 273 divides the side-wall coupling panel 266 from the side-wall intermediate panel 267 and the creased line 271 divides the intermediate panel 267 from the side-wall coupling panel 266. A semi-transparent element 275 is shown on the side-wall coupling panel 266. A slot 277 can be provided to create an entry to a pocket between the semi-transparent element 275 and the bottle's external side wall. Extending out of the pocket from the slot 277 are inserts 280 which may be pieces of chewing gum, informational leaflets or anything shaped appropriately for the being coupled to the bottle by attachment to or insertion into the slot 277 and pocket. FIG. 2D shows this embodiment from a top perspective. Although the embodiments showing FIGS. 2A-2E has a plurality of labels and informational inserts, less than all of those shown, e.g., a single one shown, can be incorporated into some embodiments.

Figure 3:
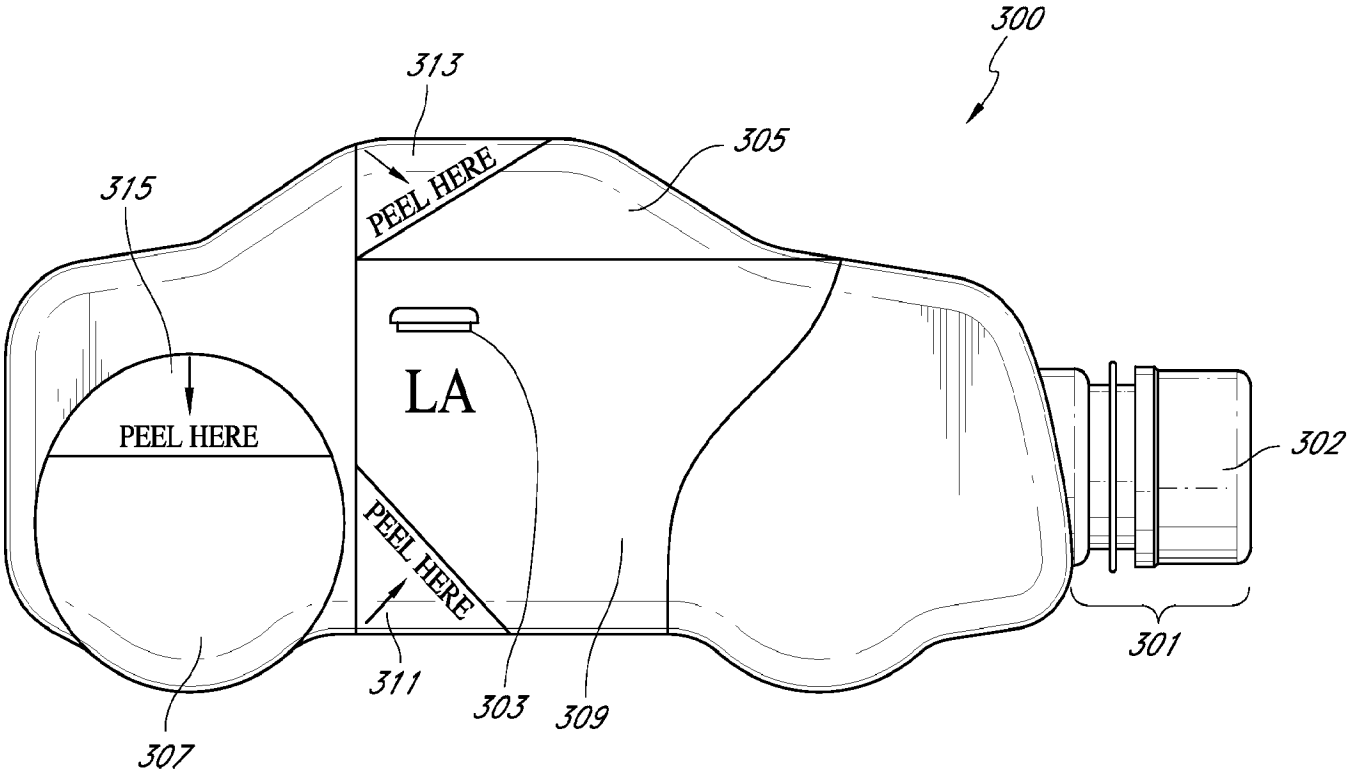
FIG. 3 shows an embodiment having structure and labeling resembling an automobile.

FIG. 3 shows another embodiment. Here, the bottle 300, shown from one side, has structure and labeling that creates the impression of an automobile. The bottle 300 has a dispensing and receiving element 301 that includes a removable and replaceable cap 302 and allows the bottle 300 to be used with bottling equipment. An element resembling a door handle 303 adorns the automobile bottle's door. A right-door-window-label 305 is coupled to the passenger-side window, which corresponds to the passenger door in an automobile, though the label could be on the other side in some embodiments. Also, a right-rear-wheel-label 307 covers the portion of the bottle resembling the right rear tire and a right-door-panel label 309 covers the automobile bottle's right door. Each label has a tab element 311, 313, 315 designed to allow a user to easily separate at least a portion of the label from the bottle 300. Users can peel any of these tabs 311, 313, 315 away from the position shown in FIG. 3, and, starting with a tabbed portion of the label's edge, reveal portions of the bottle or label lying beneath the label's outer surface. Force created by the user pulling a tab causes a tabbed panel or portion to separate from the bottle 300. As a tabbed panel separates from the bottle 300, the force applied by the user becomes more normal relative to the bottle's 300 outer side wall. The previously hidden label portion is separated from the bottle's outer side wall to reveal printed matter or other elements containing information. Any of the structures discussed above, e.g., the accordion-like folds, perforations, etc., could be incorporated into any of the labels 311, 313, 315.

Figure 4C:
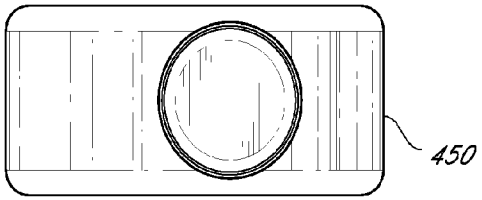
FIG. 4C shows a front-end view of the embodiment shown in FIG. 4A and FIG. 4B.
Figure 4B:
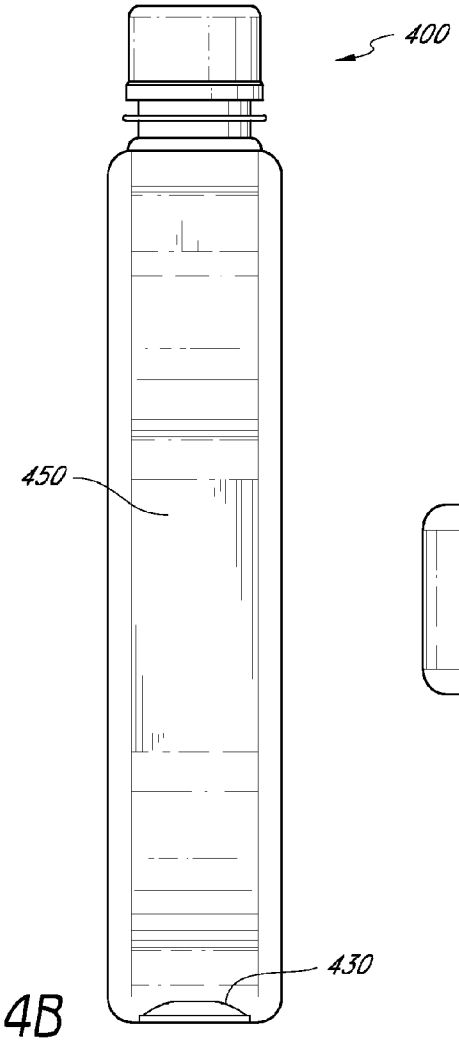
FIG. 4B shows a top view of the embodiment of FIG. 4A.
Figure 4A:
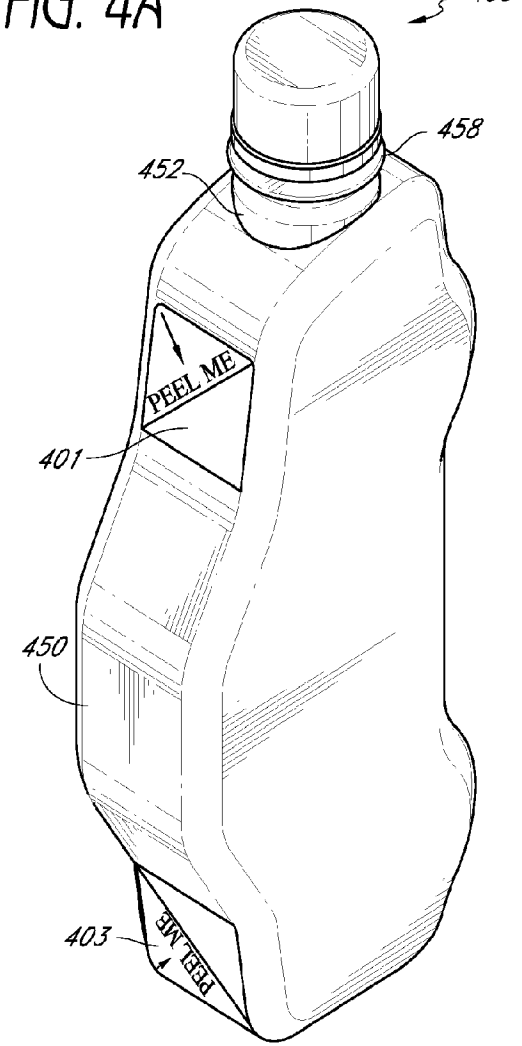
FIG. 4A shows an embodiment in which an informational attachment is located on a top surface of a bottle.

FIG. 4A shows an embodiment in a perspective view. The bottle 400 has two labels 401, 403 with tabs for peeling, one on the portion of the bottle resembling a hood 401 and another on the portion resembling the trunk 403. Users pull tabs to reveal what lies beneath the label or on its previously unexposed portion. FIG. 4B shows a view of the bottle 400 normal to the roof portion of the automobile shape 450 and FIG. 4C shows a top view of the bottle.

Figure 5:
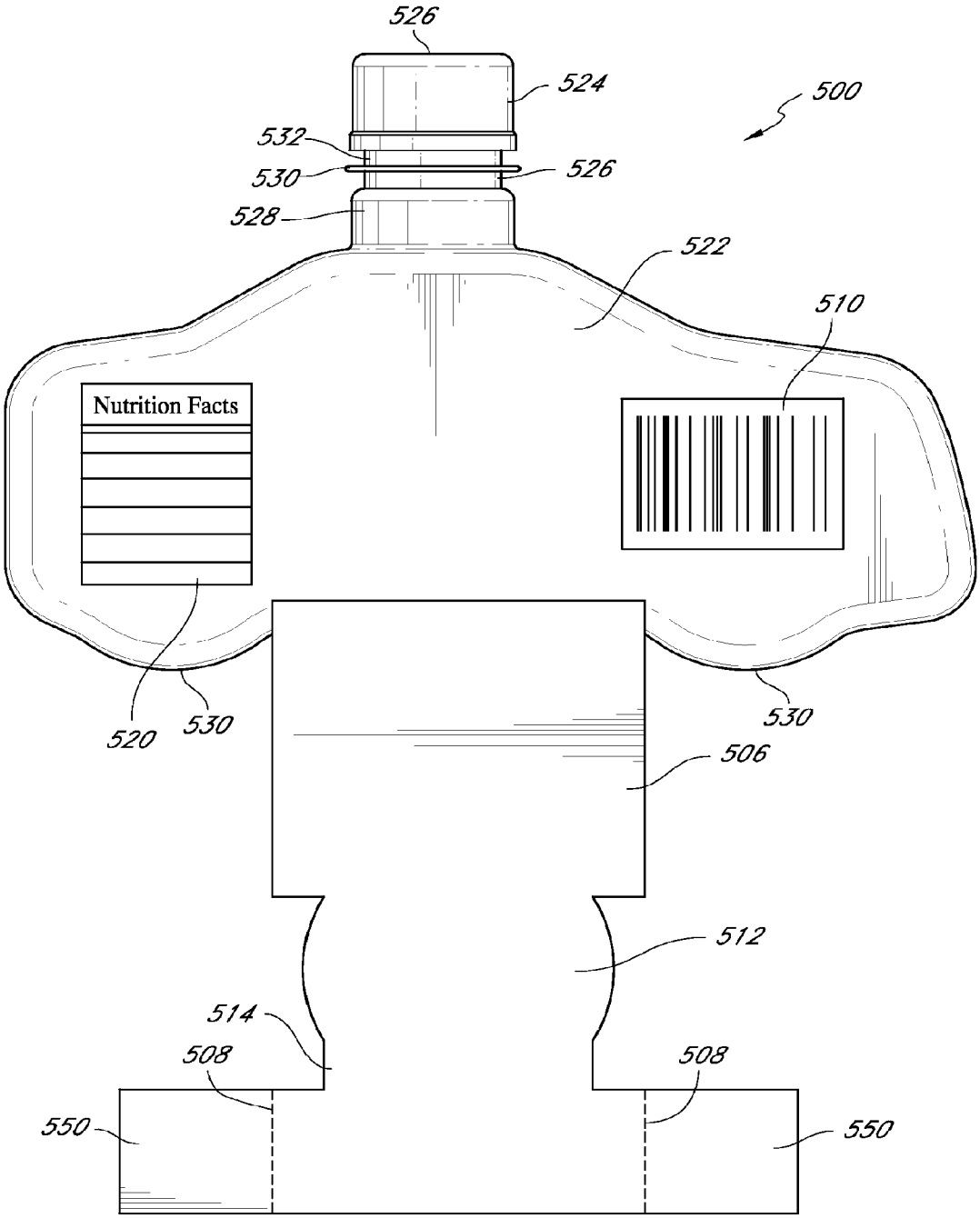
FIG. 5 is a side view of another embodiment having an informational attachment in an extended configuration.

FIG. 5 is a side view of an embodiment. Here, the bottle's cap 524 is placed on the roof portion of the automobile shape such that onlookers can easily recognize the bottle's shape as the user imbibes. The bottle 500 can resemble a car while the bottle top's upper surface 526 faces normal to the bottle's bottom surface 530. The label element can combine two portions: an informational label 522, which has a regulatory compliance portion 520 and inventory portion 510 and one or more marketing portions 506, 512, 514. The regulatory compliance and inventory portion 510 displays facts typically shown on food or beverage containers. The label's marketing portion 506, 512, 514 folds out from a first position where it was more closely coupled to the bottle 500, as described in relation to FIG. 1B and FIG. 2C. The label's coupling portion 506 connects an intermediate portion 512 to the bottom portion 514 which has two folded or perforated lines 508 that allow convenient folding and tearing of separable portions 550 of the label.

Figure 6:
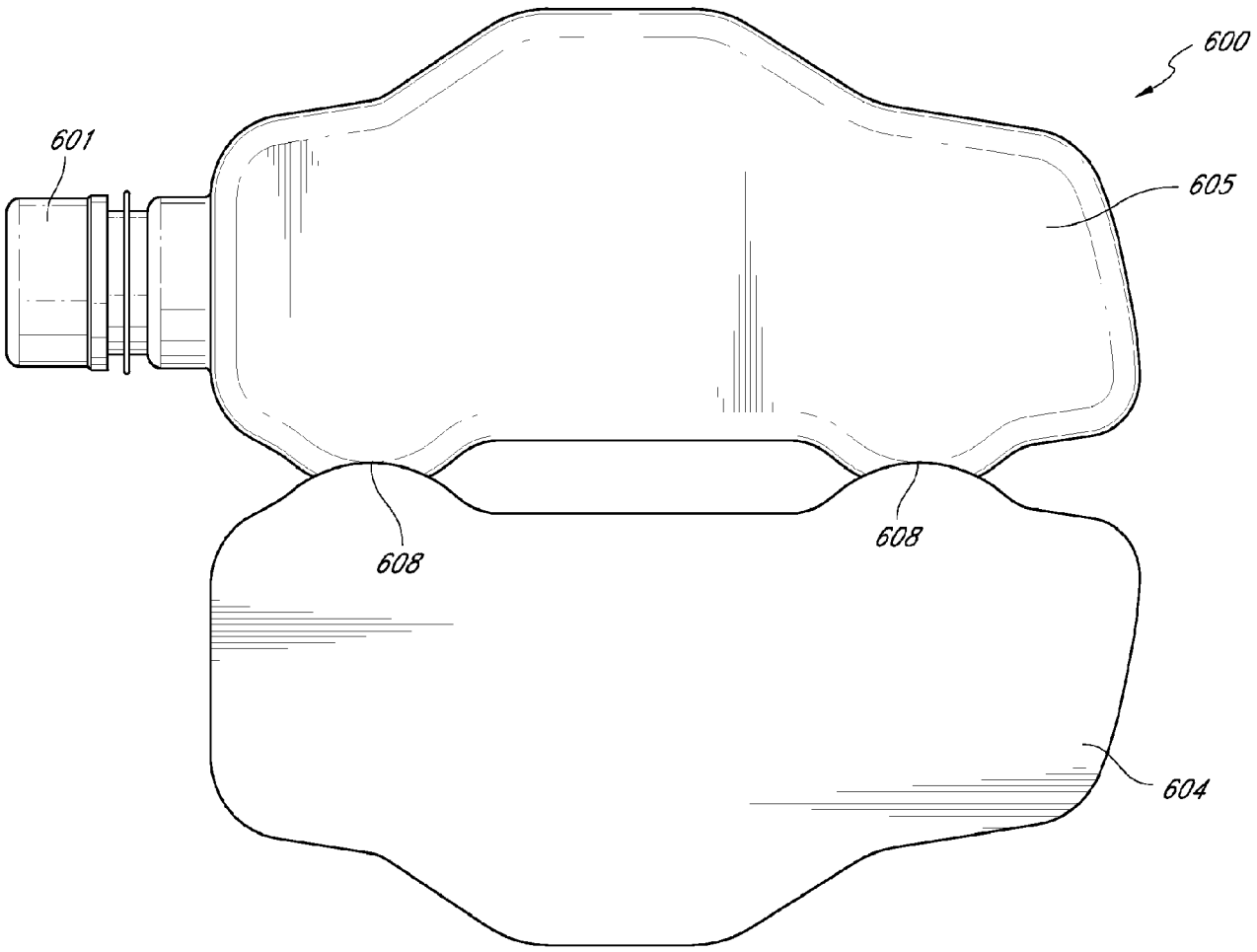
FIG. 6 is one embodiment having an informational attachment in an extended configuration.

FIG. 6 is another embodiment of a bottle 600. The bottle's top is at the portion of the bottle 600 resembling a vehicle's rear and a first label portion 604 is folded away from a second label portion 605. The label portions are coupled by suitable means at the bottle's bottom portion 608 which here resembles a tire. Peeling off the label, users experience the satisfaction of peeling off the side of an automobile and reveal information previously hidden. Those using the bottle 600 to convey information or to earn users' attention and convey sufficiently sized or detailed information through the label's large surface area and shape, which resembles an automobile's silhouette.

Figure 7:
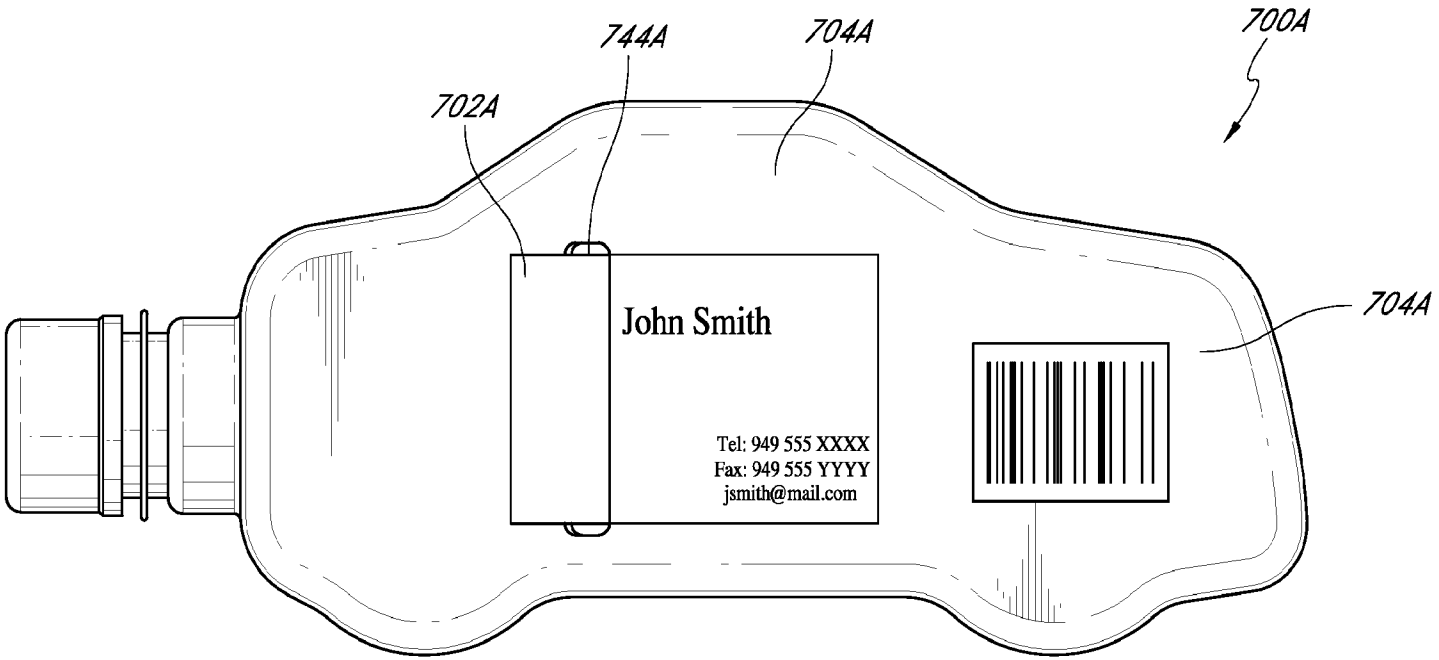
FIG. 7 is another embodiment with a sleeve for dispensing an informational element, the sleeve completed with a bottle.

FIG. 7 shows one embodiment in which a consumer item is coupled with an information component. In one implementation the consumer item can be a bottle 700A, e.g., a water bottle, and an information component 704A can be coupled with a surface of the bottle 700A. In some applications it is preferred that the bottle 700A have a novelty shape. For example, such a shape may be related to a particular industry in which the consumer item is to be used for promotion. In one application, the consumer item is used in an industry related to sale or promotion of sales of automobiles or components for automobiles. So, it may be advantageous to form the consumer item, e.g., the bottle 700A in a shape resembling an automobile.

In the illustrated embodiment, the bottle 700A is formed in shape of an automobile and the information component 704A is coupled with a side surface 701A of the bottle 700A. The side surface 701A can correspond to a middle portion of the bottle, which could correspond to the doors of the automobile.

The information component 704A can comprise one or a plurality of features. For example, the information component 704A can include a bar code or other inventory tracking device. Depending on the contents of the bottle 700A, the information component 704A also can include information for compliance with regulations, such as a listing of ingredients or nutritional information.

In one embodiment, the information component 704A includes a slot 744A into which an item 702A can be removably inserted. For example, where the bottle 700A or other consumer items is intended to promote the services of a company or professional, such as a salesman, a business card can be inserted into the slot 744A. The business card can be removed by the consumer and kept for later use after the contents of the bottle 700A are consumed. As such, the person or business using the consumer item, such as the bottle 700A, can serve two needs simultaneously: first to promote their business or service, and second to provide a beverage for consumption by the user.

Depending on the business model, the bottle 700A (or other consumer item) can be sold or given to the target audience. For example, at various public events items are sometimes given away primarily to promote businesses among those attending the event. It is common, for example, for promotional materials to be given to participants in competitive athletic events, such as a marathon. However, it would be even more convenient to combine a beverage with a promotional item, such as a business card. In this way, the consumable item can be consumed by the individual in the target audience. Then the container, e.g., the bottle 700A can be discarded. However, the individual in the target audience can remove the item 702A from the slot 744A and kept the item 702A. This enables the individual in the target audience to retain the information on the item 702A for later reference and use. As discussed above, other devices for coupling the item 702A to the bottle 700A can be used in place of or in addition to the slot 744A.

Figure 7A:
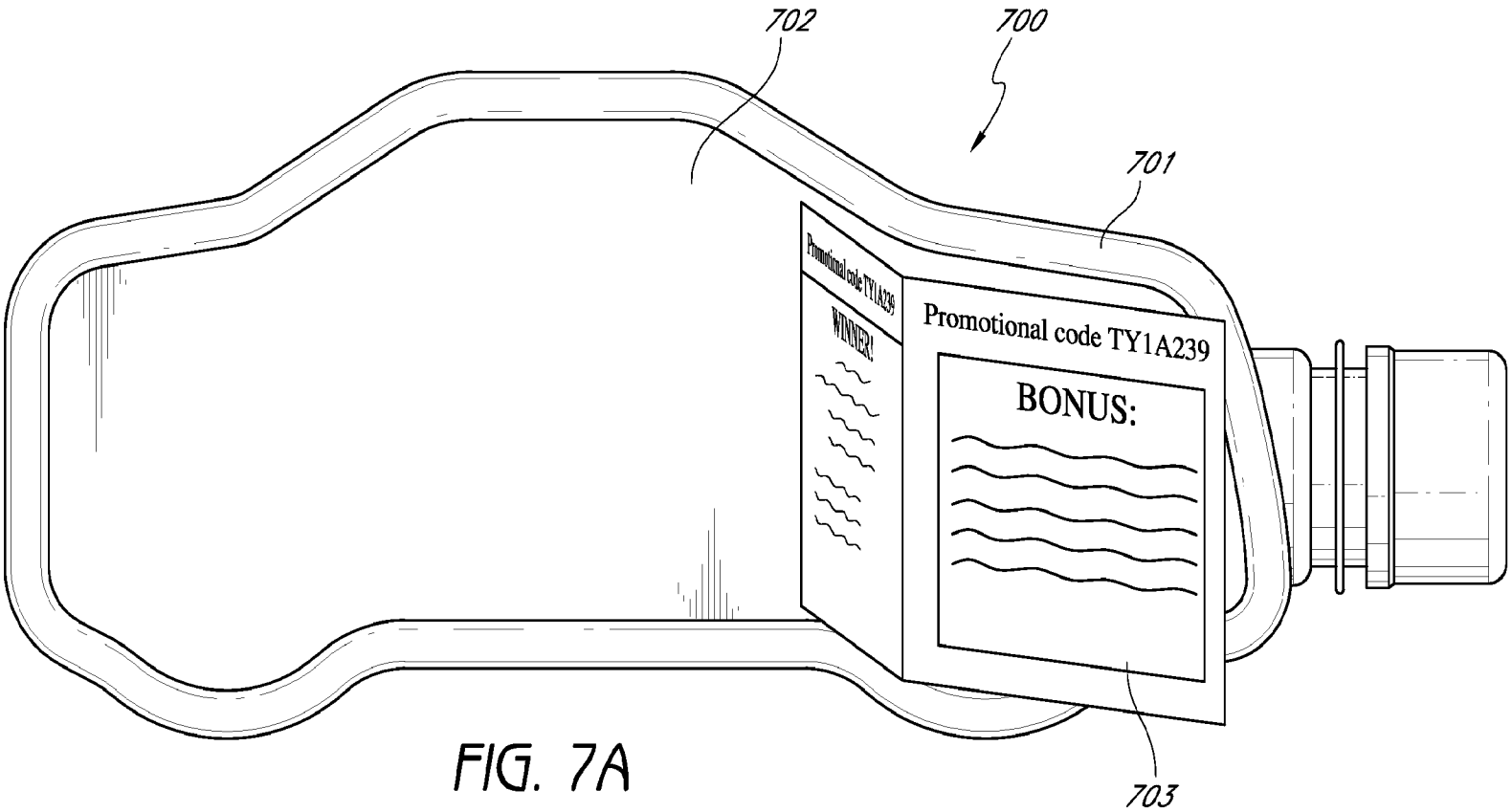
FIG. 7A shows one embodiment having a promotional pamphlet attached to the bottle's label.
Figure 7B:
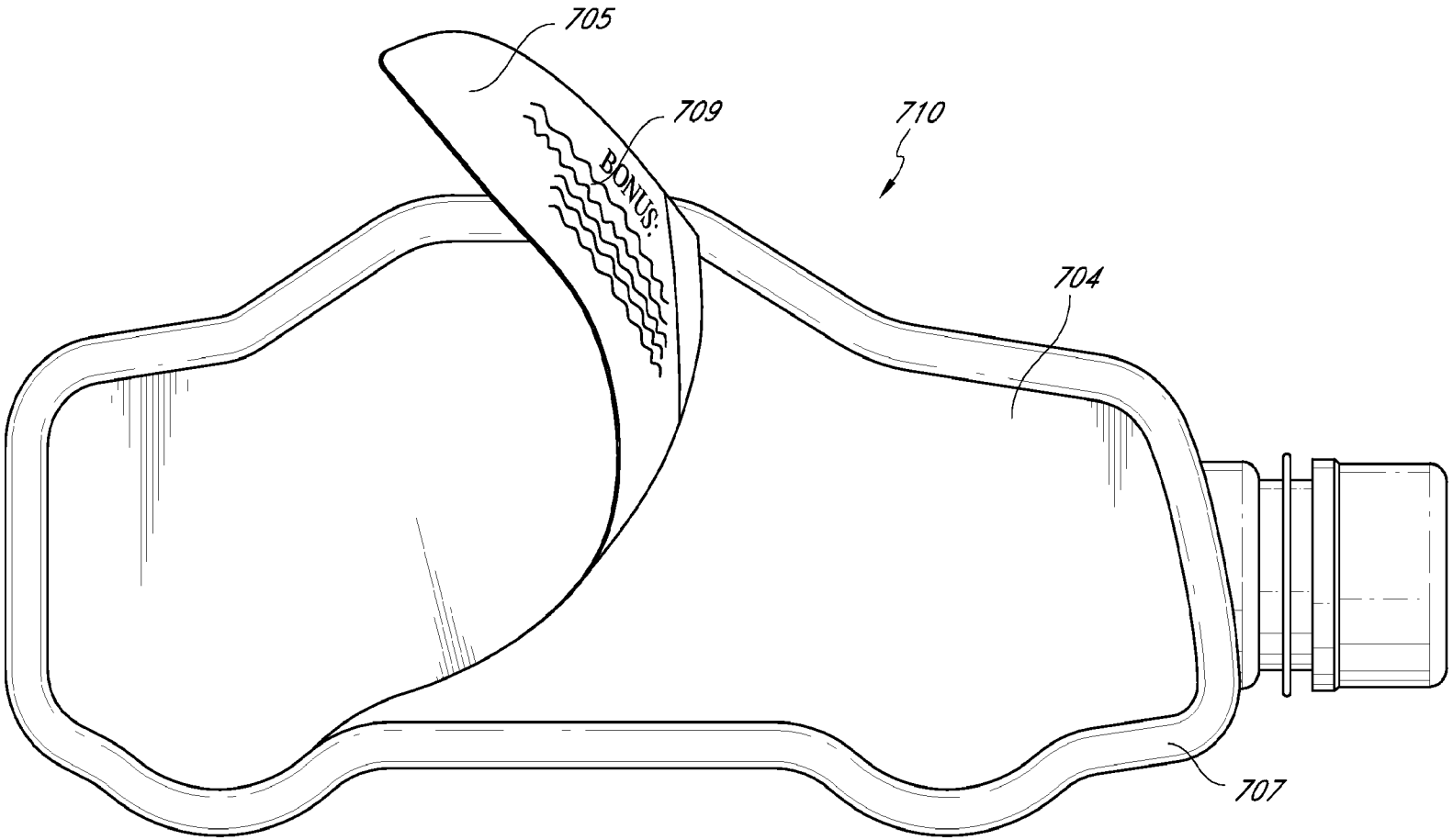
FIG. 7B shows another embodiment having a top label portion partially separated from an underlying label portion.

FIGS. 7A-7B show further embodiments. In FIG. 7A, a bottle 700 shaped like an automobile has a label 702 coupled to its side surface 701.

The figure also shows a promotional booklet 703 coupled to the bottle's side surface 701. FIG. 7B shows a top label portion 705 partially separated from an underlying label portion 704 coupled to the bottle's 710 side surface 707 to reveal promotional information 709.

Figure 8B:
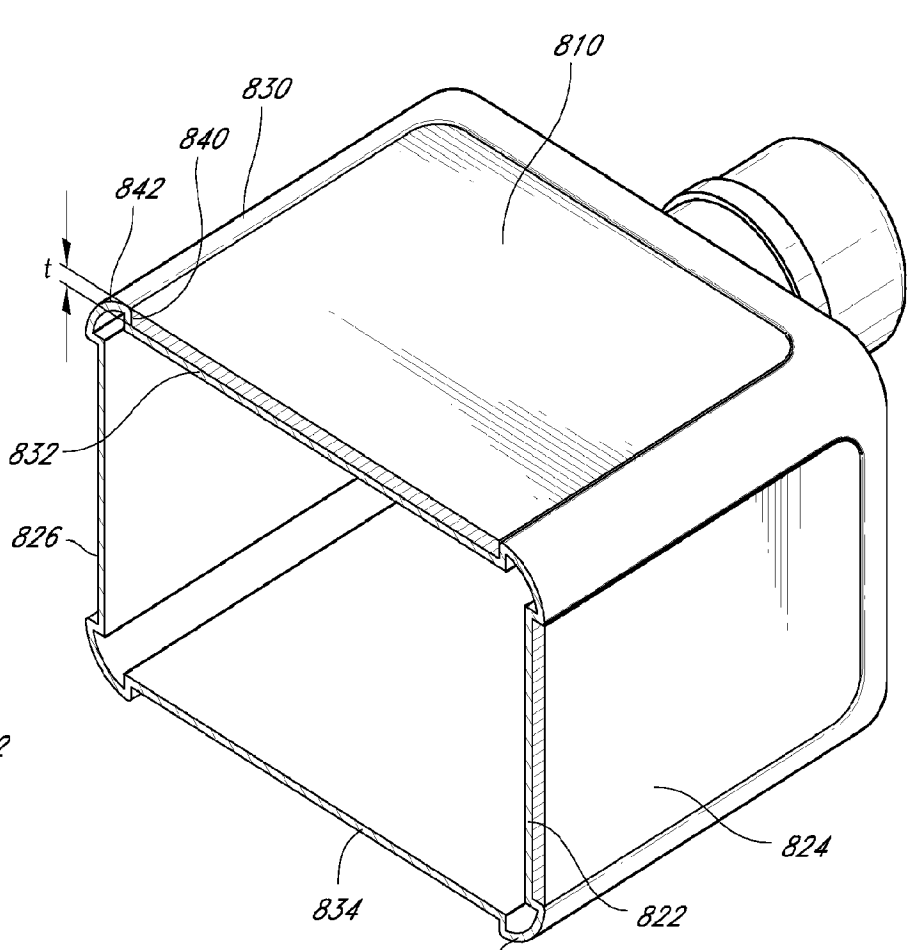
FIG. 8B shows a cutaway perspective view of FIG. 8A.
Figure 8A:
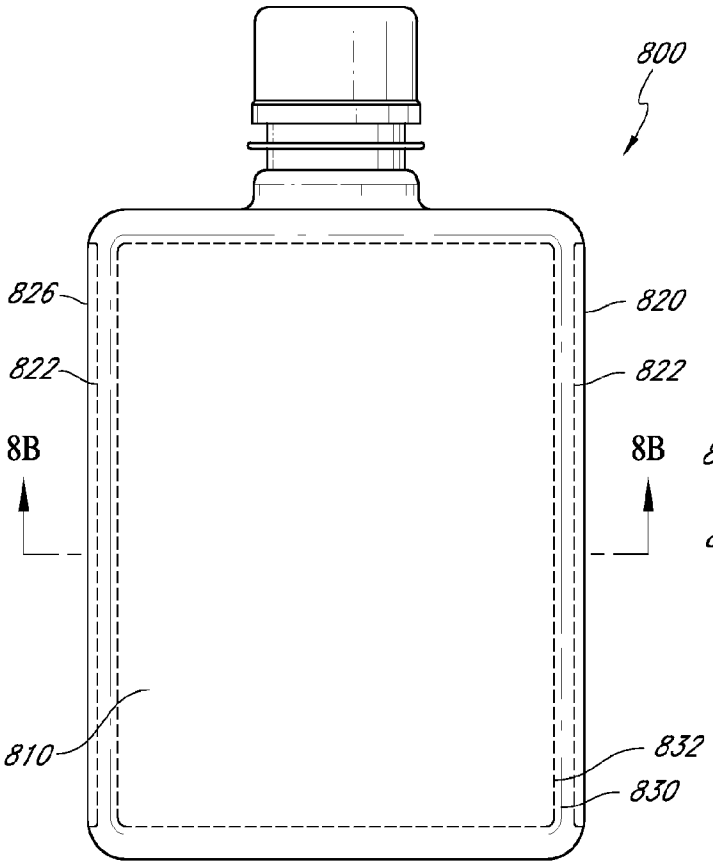
FIG. 8A shows a rectangular-shaped bottle with a label panel configuration allowing attachment of labels in a recessed portion of the side in FIG. 8B.

FIGS. 8A and 8B show further embodiments. FIG. 8A shows a bottle 800 is shaped to resemble, such as, for example, a cuboid, a rectangular prism, or a deck of cards, with sides meeting at substantially right angles adjacent to or at edge 842 defined by surface 830. Panels 826, 834 comprise substantially flat surfaces having little or no curvature. This is advantageous in providing greater external surface area visible from a given angle than provided by a bottle of the same volume having a curved or arcuate surface profile. This provides the promoter with maximum space for promotional materials while limiting the amount of fluid necessary to fill the bottle to achieve a given promotional surface area and, likewise, limiting the weight of a bottle having a given surface area. Additionally, labels need not be fabricated to account for adhering to a curved surface. The bottle may be configured to accommodate variously shaped labels. Labels 824 and 810 are affixed to surfaces 832 and 822, respectively, while surfaces 834 and 826 have no labels attached. It should be understood that this is a representative embodiment and labels can be attached on any combination of the surfaces including surfaces 826 and 832, and further including surfaces 826 and 834.

Label 810 in FIG. 8B is a substantially flat label having a thickness just less than t and extending from surface 832 to surface 830 along a wall 840 that borders and extends beyond panel 832 to surface 830 and edge 842. The surface 840 also at least partially defines a recess in which the label 810 is received. Alternative embodiments exist wherein the wall 840 extending along the surface 830 varies in thickness t, or depth, and defines a progressively deeper or shallower recess in one or more directions along the surface 830 to create a partially recessed panel. Thickness t may be any length up to, and include, 0.25 millimeters, 1 millimeter, 1.5 millimeters, 2 millimeters, 2.25 millimeters, 2.5 millimeters, 2.75 millimeters, 3.0 millimeters, or greater or less than these dimensions.

In some embodiments, labels 810 and 824 have a thickness, or depth, and extend beyond the surface of their respective panels a distance equal to or less than thickness t. Embodiments described herein provide particularly convenient and efficient storage. These embodiments further protect the labels from premature removal or damage when labeled bottles are shipped, packed or moved in a manner that may expose the bottle surfaces or the labels to rubbing, pulling contact, or friction with adjacent bottles, walls, containers, and the like. For example, in some cases, the label or informational attachment may be a certain thickness when in a secured state (e.g., when in a folded configuration and secured to the container) such that the first thickness is not substantially greater than the depth of the recessed panel. In such embodiments, the informational attachment will not extend substantially beyond the raised border when in the secured state, providing some of the above described benefits. One of skill in the art will recognize that the label thickness need not be constant to achieve similar benefit.

These embodiments further provide a comfortable and practical gripping surface. For example, it is known in the art that condensation formed on the outside of chilled liquid containers increases the risk that the bottle will slip out of the user's grip and cause injury or inconvenience. This configuration's substantially flat outer profile allows more effective gripping with the finger tips than a more curved surface does, by, for example, increasing the contact angle and thereby concentrating the pressure distribution, while providing the efficiency and storage advantages discussed above.

Such labels can also be attached on various panels, as shown, for example, by label 824 attached to panel 822. Thickness t can be equal, greater, or less than the distance that wall 840 extends beyond panel 832. All of these embodiments are shown having flat surfaces, but flat surfaces are not necessary, as would be recognized by one of ordinary skill in the art, to embody the present disclosure. Similarly, wall 840 may extend various distances beyond panel 832 just as other walls adjacent to panels 832, 826, 822, or 834 may extend various distances beyond their respectively adjacent panel.

FIG. 8B is a cutaway perspective view of FIG. 8A shown from the angle indicated by the arrows on FIG. 8A labeled 8B.

Although the foregoing inventions have been described in terms of certain preferred embodiments, other embodiments will be apparent to those of ordinary skill in the art from the disclosure herein. For example, although each label described in the drawings is coupled to a container, a skilled artisan will recognize that the present disclosure can be easily applied to any other surface or object to which a label can be coupled. The present disclosure allows coupling between the object of interest and the label to be achieved in many ways. In another embodiment, a label can be coupled to a bottle, or a portion of a bottle, by constructing at least a portion of the label from a material which bonds to the container's outer side surface through static electricity or otherwise. Alternatively, a strong or weak adhesive can be applied to the label. Another embodiment can employ a removable substance or that allows easy separation and convenient reattachment of the label, or at least one portion of the label.

In another embodiment, a portion of the label contains further information of interest. When the user changes the relative positions of at least a portion of the label and the bottle by applying force to at least a portion of the label or an element situated relative to the label in a manner capable of transferring force to the label, the changed orientation allows the user to receive visual or other information detectable by the human senses or through any other means of detecting, registering, or reading information, such as scent or electromagnetism, in a manner or to an extent not previously observed or experienced. While some embodiments have olfactory, electromagnetic, tactile, and other information, other embodiments can have nothing under the promotional label and have information printed and/or otherwise incorporated directly to the bottle's outer side wall. The many options described may be combined, omitted, or supplemented in ways easily discernable by one skilled in the art.

Perforations and folds are included in some embodiments to allow users to detach or otherwise separate or change the orientation of the label or at least one portion of the label. In yet other embodiments, folded portions can remain between that surface and the bottles outer side wall until the user creates a separation between at least a portion of the label and the bottle. As the marketing, advertising, or informational purpose for the label varies, folds and perforations can be varied or eliminates with altogether, and the portions of the label intended to be folded can be coupled to the bottle or arranged relative to the bottle in many ways.

As the skilled artisan recognizes, perforations, tabs, or other structures and elements can be substituted for one another without parting from the spirit of this disclosure. Perforated lines may be substituted with various lines or portions designed to allow clean detachment of one portion of the label from another. In one embodiment, the label is constructed, at least partially, of material that predisposes the label to tearing along defined lines. Other embodiments accomplish the same result using any combination of perforations, folding lines, or other elements, including combinations.

A tab or tabs can also help users change the label's configuration or relative spatial relationship to the bottle. In one embodiment an element assists the user removing at least a portion of a label from a container by transferring force from the tab element that the user pulls from the container to the label's edge.

Another embodiment uses the tab element or elements can serve informational purposes by providing surface area for hosting written or otherwise fixed information. Tabs are located at locations on a bottle shaped like an automobile to facilitate identification of the tabs or enhance the user's experience when peeling the labels from the automobile bottle. Such locations include the hood, the trunk, the fuel door, the passenger and driver doors, the wheels, the grill, the windshield and any other part of the automobile in which a tab can be placed.

In one embodiment, tab elements allowing the label to be attached in such a way to prevent accidental or unwanted separation from the bottle by coupling these elements with adhesive or any other material capable of holding the label in place until the user pulls, peels, or otherwise removes the tab element from its original position. A tab element can be bonded or otherwise coupled to the bottle's, or the label's outer side surface, and, optionally, to a portion of the label lying beneath the tab. In this embodiment, at least one portion of the tab element may be configured to be free from any bond or to the bottle and to thereby leave a flap or appendage attached to the rest of the label which may be freely separated from contact with the bottle. The tab element can also include or consist of a handle, lever, ribbon, or extension. This configuration facilitates information transfer and can be useful to a user working to pull or peel at least a portion of the label from the bottle while avoiding complications or frustration in use.

Tabs can be substituted with elements that facilitate separating at least a portion of the label from the bottle. In one embodiment, the label element is coupled to the bottle such that at least a portion of the label creates a pocket or enclosure between that portion and the bottle's outer side wall. In another embodiment, users can pull the tearing tie to reveal the bottles outer side wall surface. In another embodiment, a tearing tie extends through the outer surface of the pocket. Here, the tearing tie functions to tear an exterior layer of the label in a way well known in the art of packaging sticks of chewing gum. By pulling the tearing tie, users open the pocket or enclosure to reveal information or marketing material previously at least partially enclosed within the pocket or enclosure.

For a variety of reasons, product containers, particularly bottled beverage containers, provide a significant marketing and advertising medium.

Bottled beverages are ubiquitous in society today. The market has grown into a multi-billion dollar industry and, by one account, the bottled water market alone was $61 billion in 2006. Moreover, bottles and other containers typically have broad surfaces on which promotional material can be affixed and viewed.

In addition, given the consumer's natural attraction to beverage products, people are generally happy to receive and use bottled beverages, which can increase advertising effectiveness. Marketing or advertising information on a beverage container naturally remains in the hands of the consumer for an extended period while they consume the beverage, allowing for increased user interaction, thereby increasing advertising exposure. For example, an advertisement on a bottle of water can be much more likely to gain exposure than a similar advertisement on a stand-alone brochure, particularly to a thirsty user. An airline could use embodiments described herein to sell advertising space, for example, by distributing free bottled water to its customers. Retailers could use embodiments described herein to provide customers with product information, such as discount information, by providing them with bottles according to embodiments described herein as the customers enter the store. Skilled artisans will recognize from the disclosure provided herein a variety of alternative uses.

These and other combinations, methods, omissions, substitutions and modifications will be apparent to the skilled artisan in view of the disclosure herein. It is contemplated that various aspects and features of the invention described can be practiced separately, combined together, or substituted for one another, and that a variety of combination and subcombinations of the features and aspects can be made and still fall within the scope of the invention. Furthermore, the systems described above need not include all of the aspects and functions described in the preferred embodiments. Accordingly, the present invention is not intended to be limited by the recitation of the preferred embodiments.

What is claimed:

1. A beverage container configured for single use, comprising:

an inner surface defining a chamber capable of receiving a liquid and an outer surface defining a disposition portion;

an opening configured to provide access to the chamber;

an informational attachment having first and second ends and including promotional information and attached to the outer surface such that the informational attachment is substantially disposed within the disposition portion, the informational attachment movable from a secured state in which the informational attachment is substantially secured to and coupled at the first end to the outer surface to a released state in which at least a portion of the second end of the informational attachment is separated from the outer surface and at least a portion of the first end of the information attachment remains coupled to the outer surface;

the informational attachment comprising a plurality of foldable leafs positioned in a folded configuration when the informational attachment is in the secured state and positioned in an unfolded configuration in the released state; and the informational attachment further comprising an outermost leaf comprising a front portion and back portion, the front portion comprising a tab, the back portion comprising a perimeter portion attached to the outer surface adjacent the perimeter of the disposition portion to secure the foldable leafs within the disposition portion in the secured state, and the back portion detachable from the outer surface via the tab to release the foldable leafs for the released state.

2. The beverage container of claim 1, wherein the outer surface comprises at least one substantially flat panel, the at least one panel including the disposition portion.

3. The beverage container of claim 1, wherein the chamber comprises a substantially rectangular prism.

4. The beverage container of claim 1, wherein at least a portion of the informational attachment is detachable from a remaining portion of the informational attachment.

5. The beverage container of claim 4, wherein the at least a portion of the informational attachment is detachable via a perforation.

6. The beverage container of claim 1, wherein the promotional information comprises marketing or advertising information.

7. A container, comprising:

an inner surface defining a chamber, an outer surface having a raised portion and a recessed portion, the recessed portion recessed from the raised portion by a first depth;

an informational attachment having first and second ends and including promotional information and attached to the outer surface such that the informational attachment is substantially disposed within the recessed portion, the informational attachment movable from a secured state in which the informational attachment is substantially secured to and coupled at the first end to the outer surface to a released state in which at least a portion of the second end of the informational attachment is separated from the outer surface and at least a portion of the first end of the information attachment remains coupled to the outer surface, the informational attachment having a first thickness when in the secured state, wherein the first thickness is not substantially greater than the first depth such that the informational attachment does not extend substantially beyond the raised portion when in the secured state; and the informational attachment comprising a plurality of foldable leafs positioned in a folded configuration when the informational attachment is in the secured state and positioned in an unfolded configuration in the released state; and the informational attachment further comprising an outermost leaf comprising a front portion and back portion, the back portion comprising a perimeter portion attached to the outer surface adjacent the perimeter of the recessed portion to secure the foldable leafs within the recessed portion in the secured state, and the back portion detachable from the outer surface to release the foldable leafs for the released state.

8. The beverage container of claim 7, wherein the first depth is in the range of about 0.25 mm to about 3 mm.

9. The beverage container of claim 7, wherein the informational attachment is disposed on only a portion of the outer surface.

10. The beverage container of claim 7, wherein the outer surface comprises at least one substantially flat panel, the at least one panel including at least a part of the raised portion and at least a part of the recessed portion, the at least a part of the recessed portion defining a recessed plane bordered by the at least a part of the raised portion.

11. The beverage container of claim 7, wherein the chamber comprises a substantially rectangular prism.

12. The beverage container of claim 7, wherein at least a portion of the informational attachment is detachable from a remaining portion of the informational attachment.

13. The beverage container of claim 12, wherein the at least a portion of the informational attachment is detachable via a perforation.

14. The beverage container of claim 7, wherein the promotional information comprises marketing or advertising information.

* * * * *